US007501989B2

(12) United States Patent
Fujimoto et al.

(10) Patent No.: US 7,501,989 B2
(45) Date of Patent: Mar. 10, 2009

(54) ANTENNA APPARATUS

(75) Inventors: Shingo Fujimoto, Tokai (JP); Eiji Koide, Takahama (JP); Hideaki Takahashi, Chiryu (JP); Kazunari Saito, Katagami (JP); Tomohiro Shinkawa, Katagami (JP); Toshihiko Inaba, Katagami (JP)

(73) Assignees: Aisin Seiki Kabushiki Kaisha, Aichi-ken (JP); Mitsumi Electric Co., Ltd., Tokyo (JP)

( * ) Notice: Subject to any disclaimer, the term of this patent is extended or adjusted under 35 U.S.C. 154(b) by 85 days.

(21) Appl. No.: 11/723,540

(22) Filed: Mar. 20, 2007

(65) Prior Publication Data

US 2007/0216597 A1 Sep. 20, 2007

(30) Foreign Application Priority Data

Mar. 20, 2006 (JP) ..... 2006-076637

(51) Int. Cl.
*H01Q 1/32* (2006.01)

(52) U.S. Cl. ..... 343/713; 343/711

(58) Field of Classification Search ..... 343/713, 343/711, 702, 700 MS
See application file for complete search history.

(56) References Cited

U.S. PATENT DOCUMENTS

| | | | | |
|---|---|---|---|---|
| 6,023,245 | A * | 2/2000 | Gomez et al. | 343/725 |
| 6,879,294 | B2 * | 4/2005 | Yuanzhu | 343/725 |
| 7,405,697 | B2 * | 7/2008 | Ying | 343/700 MS |
| 2005/0068236 | A1 * | 3/2005 | Noro | 343/713 |
| 2006/0071856 | A1 * | 4/2006 | Shinkai et al. | 343/700 MS |

FOREIGN PATENT DOCUMENTS

JP 2004-56773 A 2/2004

* cited by examiner

*Primary Examiner*—Hoang V Nguyen
(74) *Attorney, Agent, or Firm*—Sughrue Mion, PLLC

(57) ABSTRACT

An antenna apparatus includes a feed element, a passive element provided so as to be distanced from the feed element, a cable connected to the feed element, a main circuit board to which the feed element and the passive element are mounted, an antenna holder having a holder main surface on which the main circuit board with the feed element and the passive element is held, a first feed element provided surface formed on the holder main surface of the antenna holder in order to hold the feed element and a first passive element provided surface formed on the holder main surface of the antenna holder in order to hold the passive element.

20 Claims, 5 Drawing Sheets

ANTENNA APPARATUS

CROSS REFERENCE TO RELATED APPLICATIONS

This application is based on and claims priority under 35 U.S.C. §119 to Japanese Patent Application 2006-076637 filed on Mar. 20, 2006, the entire content of which is incorporated herein by reference.

FIELD OF THE INVENTION

The present invention relates to an antenna apparatus, specifically relates: to a telephone antenna used for a compound antenna apparatus having multiple antennas.

BACKGROUND

In a technical field related to such antenna, as is generally known, various types of antennas are mounted to a vehicle. For example, a GPS (Global Positioning System) antenna, an ETC (Electronic Toll Collection System) antenna, a VICS (Vehicle Information and Communication System) antenna, a telephone antenna and the like are mounted to the vehicle.

Specifically, the GPS (Global Positioning System) employs a satellite positioning system by use of a satellite. The GPS receives electric waves such as GPS signals from four satellites out of twenty-four earth-orbiting satellites. By measuring a positional relation and a time error between a movable body on the earth and the satellite, on the basis of a principle of a triangular surveying, the GPS computes a position and an altitude of the movable body on a map or the like with high accuracy.

The GPS is used for a car navigation system or the like for detecting a position of a running vehicle, and such system has been widely used. A car navigation device with the car navigation system includes a GPS antenna, a processing device, a displaying device and the like. Specifically, the GPS antenna receives the GPS signal from the satellite, the processing device detects a current position of the running vehicle by processing the received GPS signal, and the display device displays the detected current position of the running vehicle on a map or the like.

The ETC (Electronic Toll Collection) is a system, which was developed for easing traffic jams at tollgates, at which a passenger pays a toll for a toll road. Specifically, the ETC is a system by which the toll is automatically paid by the passenger at the tollgate by means of a wireless communication system. More specifically, the vehicle equipped with a communicating device having an ETC antenna establishes two-way communication with an antenna provided at the tollgate in order to receive information from the vehicle, and the toll fee can be paid automatically at the tollgate without requiring the vehicle to stop.

A known compound antenna apparatus equipped with the GPS antenna, the VICS antenna and the ETC antenna is disclosed in JP2004-56773A. According to the know compound antenna apparatus, because directional characteristics of the ETC antenna differs from that of the GPS antenna and the VICS antenna, the GPS antenna and the VICS antenna are mounted to a circuit board, and the ETC antenna is independently mounted to the vehicle as a sub assembly. In this structure, when those antennas are mounted to the vehicle, a direction of the ETC antenna can be controlled separately from that of the GPS antenna and the VICS antenna.

Further, a telephone antenna in which inverted L element, serving as a feed element, is positioned so as to be close to parasitic element, serving as a passive element, is also generally known as a wide band antenna having a wide frequency range such as a cellular antenna for a vehicle.

According to the known compound antenna apparatus disclosed in JP2004-56773A in which the telephone antenna in which inverted L element, serving as the feed element, is positioned so as to be close to parasitic element, serving as the passive element, it is preferable that inverted L element and parasitic element are easily mounted without having variations on a geometrical tolerance and a dimensional tolerance thereof.

A need thus exists to provide an antenna apparatus at which a feed element and a passive element can easily be mounted without having variations of a geometrical tolerance and a dimensional tolerance as possible so that the antenna apparatus is not adversely affected by such variations.

SUMMARY OF THE INVENTION

According to an aspect of the present invention, an antenna apparatus includes a feed element, a passive element provided so as to be distanced from the feed element, a cable connected to the feed element, a main circuit board to which the feed element and the passive element are mounted, an antenna holder having a holder main surface on which the main circuit board with the feed element and the passive element is held, a first feed element provided surface formed on the holder main surface of the antenna holder in order to hold the feed element and a first passive element provided surface formed on the holder main surface of the antenna holder in order to hold the passive element.

BRIEF DESCRIPTION OF THE DRAWINGS

The foregoing and additional features and characteristics of the present invention will become more apparent from the following detailed description considered with reference to the accompanying drawings, wherein.

DETAILED DESCRIPTION

An embodiment of the present invention will be explained in detail in accordance with the attached drawings.

Figure 1:
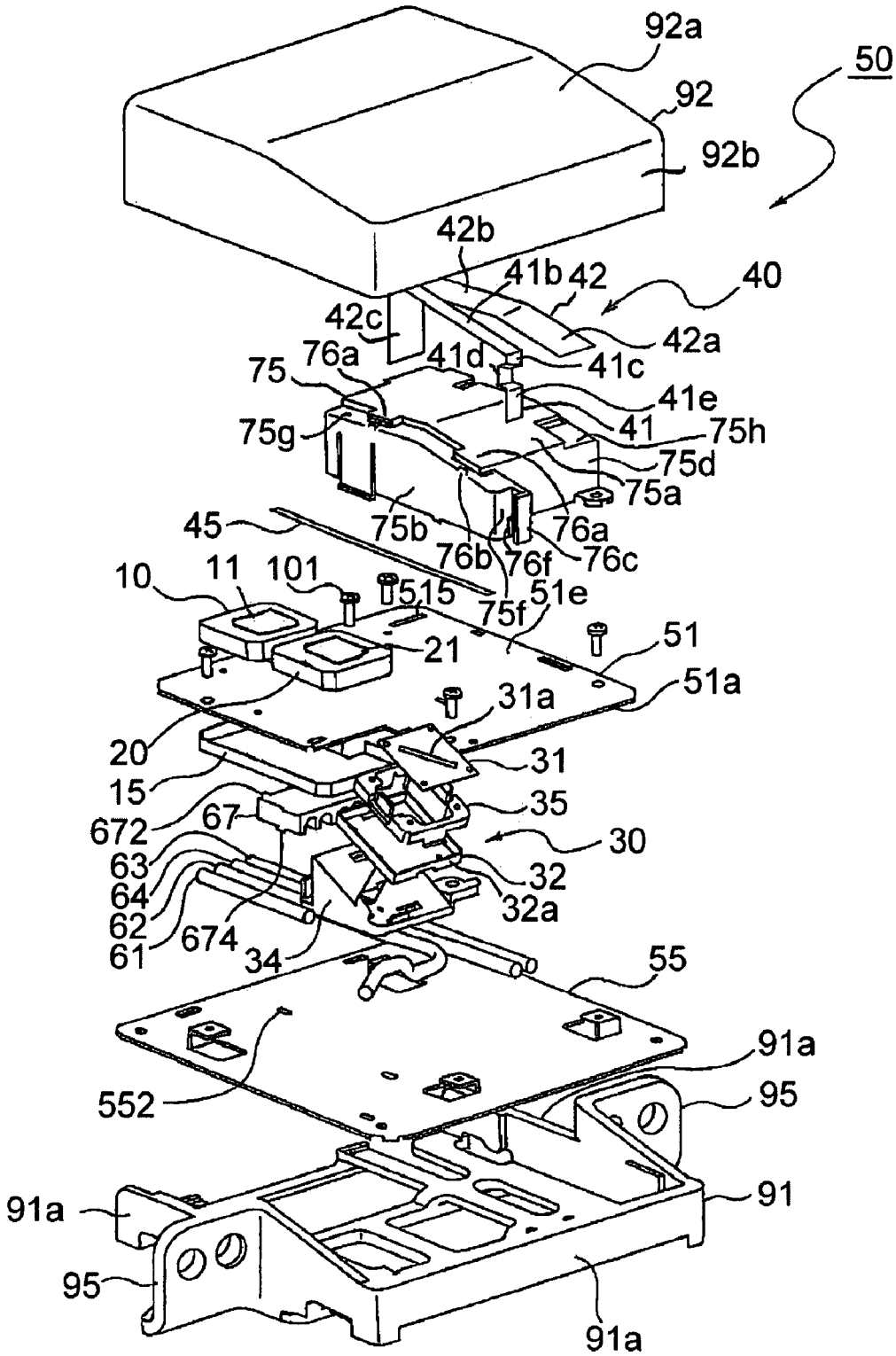
FIG. 1 illustrates an exploded perspective view of the compound antenna apparatus seen from a front right direction.
Figure 2:
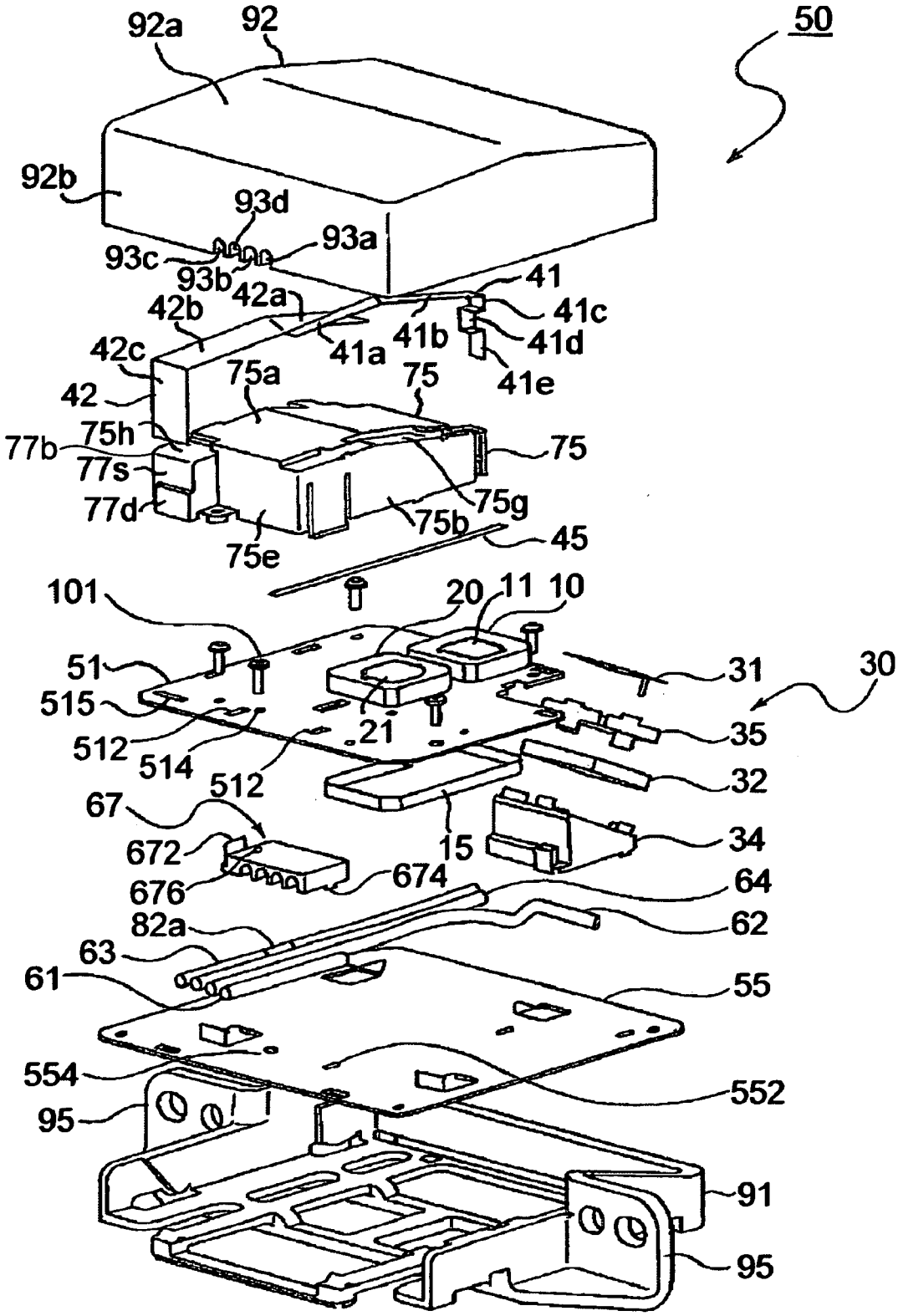
FIG. 2 illustrates an exploded perspective view of the compound antenna apparatus seen from a rear right direction.
Figure 3:
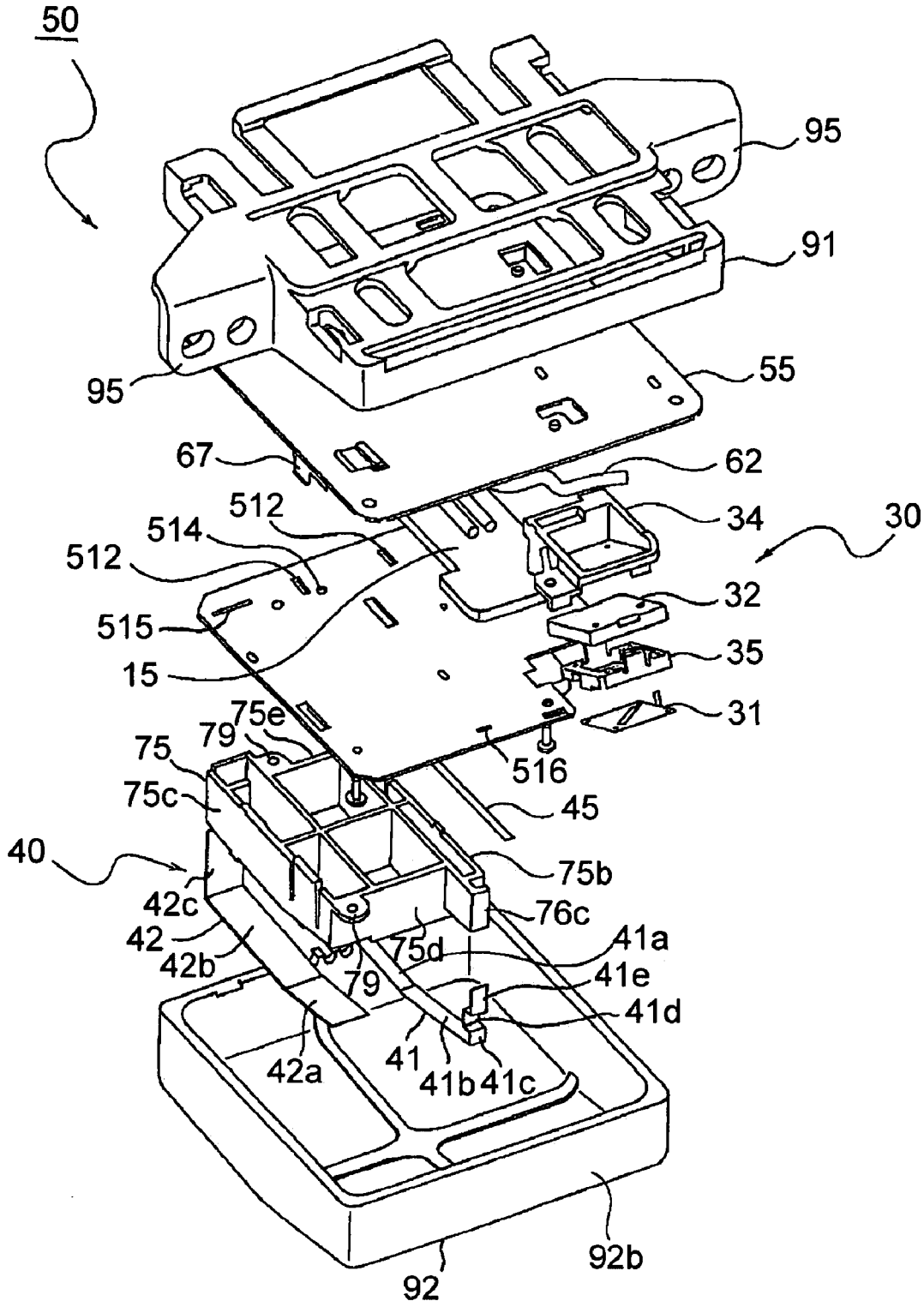
FIG. 3 illustrates an exploded perspective view of the compound antenna apparatus seen from the bottom.
Figure 4F:
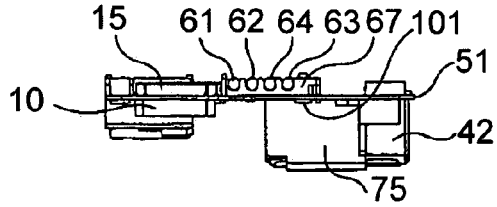
FIG. 4F illustrates a rear view (back view) of the compound antenna apparatus.
Figure 4B:
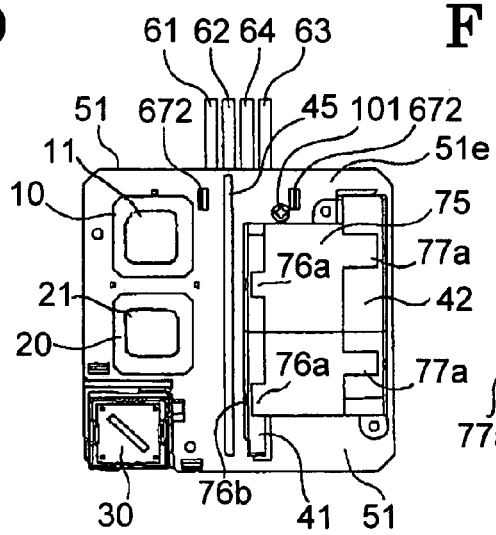
FIG. 4B illustrates a flat view of the compound antenna apparatus.
Figure 4D:
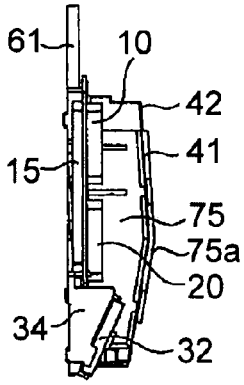
FIG. 4D illustrates a left side view of the compound antenna apparatus.
Figure 4E:
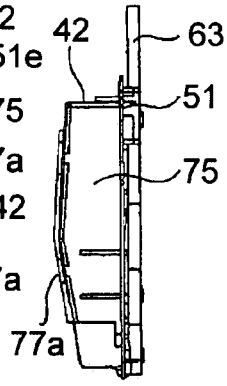
FIG. 4E illustrates a right side view of the compound antenna apparatus.
Figure 4C:
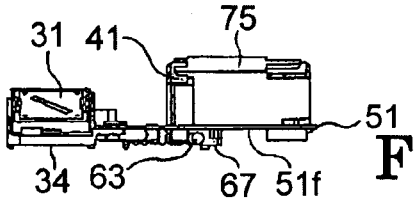
FIG. 4C illustrates a front view (elevation view) of the compound antenna apparatus.
Figure 4A:
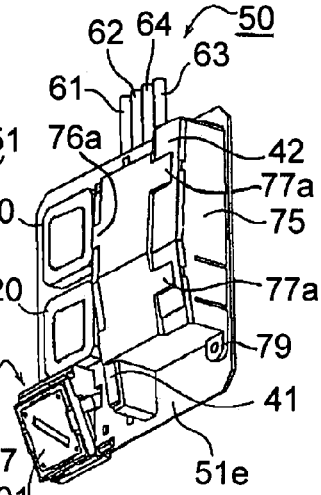
FIG. 4A illustrates an exploded perspective view of the compound antenna apparatus seen from a front right direction.
Figure 4G:
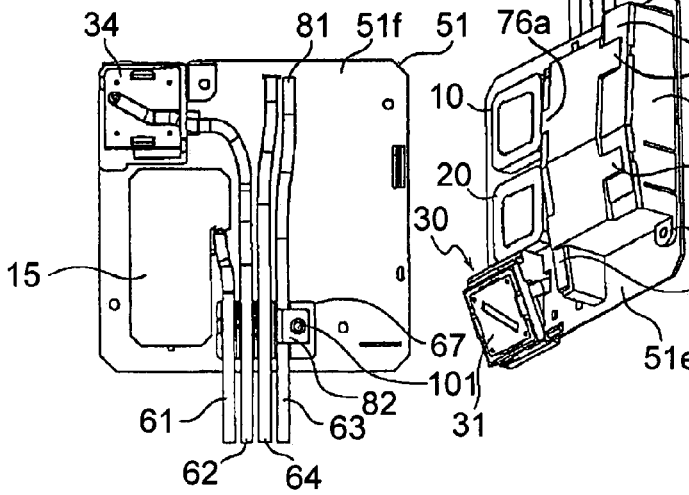
FIG. 4G illustrates a bottom plan view of the compound antenna apparatus

FIGS. 1 through 4 illustrate diagrams indicating the compound antenna apparatus 50 to which the present invention is applied. Specifically, FIG. 1 illustrates an exploded perspective view of the compound antenna apparatus 50 seen from a front right direction, FIG. 2 illustrates an exploded perspective view of the compound antenna apparatus 50 seen from a rear right direction, and FIG. 3 illustrates an exploded perspective view of the compound antenna apparatus 50 seen from the bottom.

FIG. 4 illustrates a diagram indicating the compound antenna apparatus 50 illustrated in FIG. 1 through FIG. 3 from which a top case, a bottom case and a ground plane are removed. Specifically, FIG. 4A illustrates an exploded perspective view of the compound antenna apparatus 50 seen from a front right direction, FIG. 4B illustrates a flat view of the compound antenna apparatus 50, FIG. 4C illustrates a front view (elevation view) of the compound antenna apparatus 50, FIG. 4D illustrates a left side view of the compound antenna apparatus 50, FIG. 4E illustrates a right side view of the compound antenna apparatus 50, FIG. 4F illustrates a rear view (back view) of the compound antenna apparatus 50, and FIG. 4G illustrates a bottom plan view of the compound antenna apparatus 50.

As illustrated in FIGS. 1 though 4, the compound antenna apparatus 50 includes a main circuit board 51 and a ground plane (ground plate) 55. Specifically, on the main circuit board 51 formed in an approximately rectangular shape, a first antenna apparatus 10, a second antenna apparatus 20, a third antenna apparatus 30 and a fourth antenna apparatus 40 are mounted. In this example illustrated in the drawings, the first antenna apparatus 10 is a GPS antenna, the second antenna apparatus 20 is a VICS antenna, the third antenna 30 is an ETC antenna, and the fourth antenna 40 is a telephone antenna.

The first antenna apparatus 10 includes a first antenna element 11 and a LNA (Low Noise Amplifier) circuit (not shown) connected to the first antenna element 11. In the example illustrated in the drawings, the first antenna element 11 is comprised of a patch antenna.

The second antenna apparatus 20 is provided so as to be distanced from the first antenna apparatus 10. The second antenna apparatus 20 includes a second antenna element 21 and a filter circuit (not shown) connected to the second antenna element 21. In the example illustrated in the drawings, the second antenna element 21 also comprises a patch antenna in the same manner as the first antenna element 11.

A signal received by the first antenna element 11 and outputted via the LNA circuit and a signal received by the second antenna element 21 and outputted via the filter circuit are combined by means of duplexer (not shown) so as to be a composite signal, and the composite signal is transmitted via the first output cable 61 to a signal processing device (not shown).

The third antenna apparatus 30 is positioned on a main surface 51*e* of the main circuit board 51 at the side of the front edge 51*a* of the main circuit board 51. The third antenna apparatus 30 is positioned in a manner where its level is lower than that of the first and second antenna elements 11 and 21. In this configuration, the third antenna apparatus 30 does not interrupt the first and the second antenna apparatuses 10 and 20 to receive the signals. Further, third antenna apparatus 30 is positioned so as to be tilted at a predetermined angle relative to the main surface 51*e* of the main circuit board 51.

More specifically, the third antenna apparatus 30 includes a third antenna element 31, a ground plane 32 positioned so as to be parallel to the third antenna element 31, a base 34 to which the ground plane 32 is mounted, and a spacer 35 provided between the third antenna element 31 and the ground plane 32. The base 34 is mounted to the ground plane 55 in a manner where it is attached to the main circuit board 51 by means of a screw.

The ground plane 32 includes a wall portion 32*a* erectly extending from a peripheral edge of the ground plane 32 toward the third antenna element 31 so as to enclose the third antenna element 31. A height of the wall portion 32*a* is set to be practically equal to or smaller than a distance between the third antenna element 31 and the ground plane 32. A spacer (not shown) having a feeding conductor (not shown) is provided between the third antenna element 31 and the ground plane 32. The third antenna element 31 is made of a metal plate formed in a rectangular shape, and a long hole 31*a* is formed on the third antenna element 31 so as to extend along one of diagonal lines of the third antenna element 31.

The signal received by the third antenna element 31 is transmitted via a coaxial second output cable 62 to an external circuit (not shown). A central conductor (internal conductor) of the second output cable 62 is connected to one end of the feeding conductor, and an external conductor of the second output cable 62 is connected to the ground plane 32.

The fourth antenna apparatus 40 is comprised of a strip-shaped feed element 41 and a strip shaped passive element 42. The passive element 42 is positioned so as to be parallel to the feed element 41. In the example illustrated in the drawings, the feed element 41 is comprised of an inverted L element, and the passive element 42 is comprised of a parasitic element.

The feed element 41 and the passive element 42 are both held by the antenna holder 75. The antenna holder 75 with those elements is mounted to the main surface 51*e* of the main circuit board 51.

The fourth antenna apparatus 40 further includes a sub antenna 45. The sub antenna 45 may be comprised of a conductive pattern formed on the main surface 51*e* of the main circuit board 51. A signal received by the sub antenna 45 is transmitted via a coaxial fourth output cable 64 to an external circuit (not shown).

The feed element 41 includes a first feed portion 41*a*, a second feed portion 41*b*, a third feed portion 41*c*, a fourth feed portion 41*d* and a fifth feed portion 41*e*. The second feed portion 41*b* is connected to the first feed pint 41*a* at one end in a longitudinal direction of the first feed portion 41*a*. The third feed portion 41*c* is connected to the second feed portion 41*b* at one end in a longitudinal direction of the second feed portion 41*b*. The fifth feed portion 41*e* is connected to the third feed portion 41*c* at one end in a longitudinal direction of the third feed portion 41*c* by means of the fourth feed portion 41*d*.

As illustrated in FIG. 2, the first feed portion 41*a* is connected to the second feed portion 41*b* so as to form an obtuse angle. The third feed portion 41*c* is formed in a manner where it is bent at one end of the second feed portion 41*b* so as to form an approximately right angle relative to the second feed portion 41*b*. The fifth feed portion 41*e* extends in the same direction as the third feed portion 41*c* below the fourth feed portion 41*d*. The fourth feed portion 41*d* is formed in an approximately C-shape in its side view and is provided between the third feed portion 41*c* and the fifth feed portion 41*e* so as to connect thereto.

The first and the second feed portions 41*a* and 41*b* are positioned so as to face the main surface 51*e* of the main circuit board 51 at the side of the front edge 51*a* of the main circuit board 51. A front portion of the first and the second feed portions 41*a* and 41*b* at the side of the front edge 51*a* of the main circuit board 51 is tilted toward the main surface 51*e* of the main circuit board 51 in order to fit the shape of an antenna holder 75 and a top case 92 as described later. The third through fifth feed portions 41*c*, 41*d* and 41*e* are positioned so as to be practically perpendicular to the main surface 51*e* of the main circuit board 51. The fourth feed portion 41*d* is formed by bending inwardly so as to be in a semi-rectangular C-shape.

The passive element 42 includes a first passive portion 42*a*, a second passive portion 42*b* and a third passive portion 42*c*. The second passive portion 42*b* is connected to the first passive portion 42*a* at one end in a longitudinal direction of the first passive portion 42*a*, and the third passive portion 42*c* is connected to the second passive portion 42*b* at one end in a longitudinal direction of the second passive portion 42*b*.

The first passive portion 42*a* is connected to the second passive portion 42*b* so as to form an obtuse angle. The third passive portion 42*c* is formed in a manner where it is bent at one end of the second passive portion 42*b* so as to form an approximately right angle relative to the second passive portion 42*b*.

The first and the second passive portions 42*a* and 42*b* are positioned so as to face the main surface 51*e* of the main circuit board 51 at the side of the front edge 51*a* of the main circuit board 51. A front portion of the first and the second passive portion 42*a* and 42*b* is tilted toward the main surface 51*e* of the main circuit board 51 so as to fit to the antenna holder 75 and the top case 92 as described later. The third passive portion 41*c* is positioned so as to be practically perpendicular relative to the main surface 51*e* of the main circuit board 51.

Figure 5:
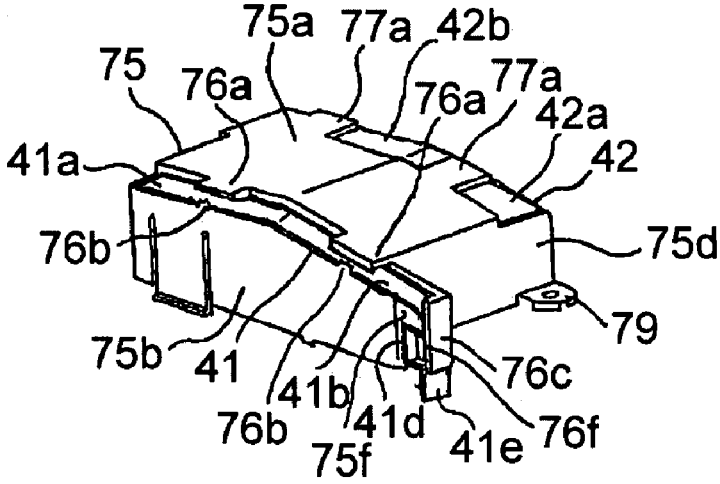
FIG. 5 illustrates a perspective view of an antenna holder illustrated in FIGS. 4A-4G having a feed element and a passive element.
Figure 6:
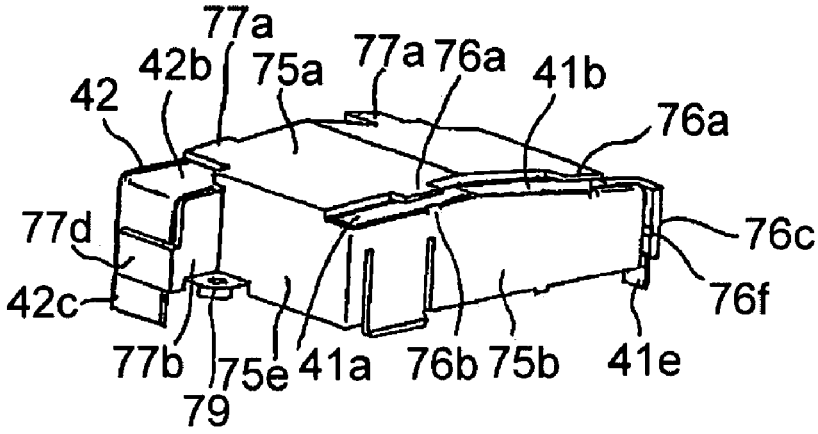
FIG. 6 illustrates a perspective view seen from a backside of the antenna holder illustrated in FIG. 5 having the feed element and the passive element.

As illustrated in FIGS. 5 and 6, the antenna holder 75 includes a holder main surface 75*a*, a first holder wall portion 75*b*, a second holder wall portion 75*c*, a third holder wall portion 75*d* and a fourth holder wall portion 75*e*. The holder main surface 75*a* is formed in an approximately rectangular plate shape. The first and the second holder wall portion 75*b* and 75*c* each erectly extends from in the vicinity of a peripheral edge of the holder main surface 75*a* so as to face each other. The third and the fourth holder wall portions 75*d* and 75*e* each also erectly extends from in the vicinity of a peripheral edge of the holder main surface 75*a* so as to face each other.

On the holder main surface 75*a*, a first feed element provided surface 75*g* and a first passive element provided surface 75*h* are formed. Specifically, the first feed element provided surface 75*g* is formed along the first holder wall portion 75*b*, and the first passive element provided surface 75*h* is formed along the second holder wall portion 75*c* facing the first holder wall portion 75*b*.

The first feed element provided surface 75*g* is formed so as to be lower than the holder main surface 75*a*. The antenna holder 75 includes plural feed element holding portions 76*a*, plural nail portions 76*b* and a feed element supporting portion 76*c*. Each feed element holding portion 76*a* extends from the holder main surface 75*a* so as to face the first feed element provided surface 75*g*. Each nail portion 76*b* protrudes from the first holder wall portion 75*b* so as to be higher than the first feed element provided surface 75*g*. The feed element supporting portion 76*c* is formed at the side of one end of the third wall portion 75*d*.

The first feed portion 41*a* and 41*b* of the feed element 41 are held by the first feed element provided surface 75*g* and the feed element holding portion 76*a* so as to be sandwiched therebetween. The first and the second feed portions 41*a* and 41*b* of the feed element 41 are positioned by means of nail portion 76*b* serving as a positioning portion. The feed element supporting portion 76*c* is positioned so as to face an end surface 75*f* of the first holder wall portion 75*b*, the end surface 75*f* being parallel to the third holder wall portion 75*d*. The third through fifth feed portions 41*c*, 41*d* and 41*e* are supported between the feed element supporting portion 76*c* and the end surface 75*f*.

A protruding portion 76*f* is formed at the feed element supporting portion 76*c* on a surface facing the end surface 75*f*. The fourth feed portion 41*d* engages the protruding portion 76*f*. An end portion of the fifth feed portion 41*e* is positioned so as to extend toward the back side of the main circuit board 51 through a through hole 516 formed on the main circuit board 51. The fifth feed portion 41*e* further extends in the opposite direction of the holder main surface 75*a* of the antenna holder 75 so as to be positioned outside of the antenna holder 75.

The first passive element provided surface 75*h* is formed so as to be lower than the holder main surface 75*a*. The antenna holder 75 includes plural passive element holding portions 77*a* and passive element supporting portion 77*d*. Specifically, each passive element holding portion 77*a* extends from the holder main surface 75*a* so as to face the first passive element provided surface 75*h*. The passive element supporting portion 77*d* is formed, at one end of the second wall portion 75*c*, at the protruding portion 77*b* extending from the fourth wall portion 75*e* so as to abut the first passive element provided surface 75*h*.

The first and the second passive portions 42*a* and 42*b* are held by the passive element holding portions 77*a* and the first passive element provided surface 75*h* so as to be sandwiched therebetween. The passive element supporting portion 77*d* faces an end surface 77*s* of the protruding portion 77*b*, the end surface 77*s* being parallel to the fourth wall portion 75*e*, and the third passive portion 42*c* of the passive element 42 is supported between the fourth wall portion 75*e* and the passive element supporting portion 77*d*. The third passive portion 42*c* extends in an opposite direction of the holder main surface 75*a* of the antenna holder 75 so as to be positioned outside of the antenna holder 75. An end of the third passive portion 42*c* extends towards the bottom surface of the main circuit board 51 through a through hole 515 formed on the main circuit board 51.

Further, plural holder fixing portions 79 are formed at the antenna holder 75. The antenna holder 75 is fixed to the main circuit board 51 by means of a screw 101 screwed into each holder fixing portion 79.

On the bottom surface of the main circuit board 51, a ground pattern (not shown) is formed. Thus, the main circuit board 51 also functions as a ground plate. A point at which the inverted L element 41 contacts the main surface 51*e* of the main circuit board 51 is a feed point. An internal conductor (central conductor) (not shown) of the coaxial third output cable 63 is connected to the feed point. Further, an external conductor (not shown) of the third output cable 63 is eclectically connected to the ground pattern formed on the bottom surface of the main circuit board 51 by means of soldering. In this configuration, the third output cable 63 includes a first grounded portion 82*a*.

Further, in the compound antenna apparatus 50, a plate spring 82 is wounded around an exposed portion of the external conductor of the third output cable 63, and the plate spring 82 together with the third output cable 63 is fixed on the main circuit board 51 by means of a screw. Thus, the third output cable 63 is electrically connected to the ground pattern formed on the bottom surface of the main circuit board 51.

Furthermore, in the compound antenna apparatus 50, a metal member for grounding (not shown) may be used alternatively. Specifically, the metal member is wounded around an exposed portion of the external conductor of the third output cable 63, and the metal member together with the third output cable 63 is fixed on the main circuit board 51 by means of caulking. Thus, the third output cable 63 is electrically connected and grounded to the ground pattern formed on the bottom surface of the main circuit board 51.

In the compound antenna apparatus 50, the first through fourth output cables 61-64 are distributed on the bottom surface 51*f* of the main circuit board 51. The first through fourth output cables 61-64 are supported by a cable holder 67 attached on the bottom surface 51*f* of the main circuit board 51. Thus, the first through fourth output cables 61-64 are provided between the main circuit board 51 and the ground plane 55.

In the compound antenna apparatus 50, the LNA (Low Noise Amplifier) circuit (not shown) of the first antenna apparatus 10 and the filter circuit (not shown) of the second antenna apparatus 20 are mounted to the bottom surface 51*f* of the main circuit board 51. The LNA circuit and the filter circuit are covered by a shielding case 15 provided on the bottom surface 51*f* of the main circuit board 51.

The compound antenna apparatus 50 further includes a bottom case 91 to which the main circuit board 51 is mounted. The bottom case 91 is formed in a rectangular shape so as to be slightly larger than the main circuit board 50.

The compound antenna apparatus 50 further includes a top case 92 covering the first through fourth antenna apparatus 10, 20, 30 and 40. The top case 92 includes a case main surface 92*a* and a peripheral wall portion 92*b*. The case main surface 92*a* is formed so as to correspond the holder main surface 75*a* of the antenna holder 75, and the peripheral wall portion 92*b* is formed so as to erectly extend from in the vicinity of a peripheral edge of the case main surface 92*a*. In this configuration, the first through fourth antenna apparatus 10, 20, 30, and 40 are housed into the bottom case 91 and the top case 92.

The compound antenna apparatus 50 having the abovementioned configuration is mounted within a dashboard or the like at the interior of the vehicle in a manner where the front edge 51*a* of the main circuit board 51 faces forward.

Thus, in this configuration, because the first through fourth antenna apparatuses 10, 20, 30 and 40 are positioned at an appropriate position on the main circuit board 51, emission characteristic of each antenna apparatus can be maintained at a required level.

Further, on the peripheral wall portion 92*b* of the top case, first through fourth openings 93*a*, 93*b*, 93*c* and 93*d* are formed. Through each of the openings, the first through fourth output cables 61, 62, 63 and 64 are distributed outside of the antenna apparatus.

The bottom case 91 includes wall portions 91*a* erectly extended so as to surround an outer peripheral surface of the top case 92 except the rear edge of the bottom case 91. At each of the left and the right side of the wall portions 91*a* of the bottom case 91, a pair of brackets 95 is attached. The compound antenna apparatus 50 is attached within the dashboard or the like by means of the brackets 95. The compound antenna apparatus 50 is also embedded within a packet tray (at rear).

Thus, by means of the brackets 95, the compound antenna apparatus 50 can easily be attached to the vehicle.

The current invention is not be limited to the abovementioned embodiment and may be modified. For example, in the embodiment, the feed element 41, the passive element 42, and the holder main surface 75*a* of the antenna holder 75 are bent so as to fit the shape of the case main surface 92*a* of the top case 92, however they may be straight. Further, in the embodiment, the fourth antenna apparatus is mounted to the ground plate or the circuit board, however, the ground plate and the circuit board may not be provided.

According to the embodiment, because the feed element and the passive element can be mounted to the antenna holder so as to be sub-assembled, the sub-assembled antenna holder having the feed element and the passive element may easily be mounted.

Further, according to the embodiment, because the antenna holder is constructed as a unit, the antenna apparatus is not adversely affected by a geometrical tolerance therefore a dimensional tolerance is possible.

According to the embodiment, the each holder wall portion may be provided so as to erect from a peripheral edge of the holder main surface The principles, preferred embodiment and mode of operation of the present invention have been described in the foregoing specification. However, the invention which is intended to be protected is not to be construed as limited to the particular embodiments disclosed. Further, the embodiments described herein are to be regarded as illustrative rather than restrictive. Variations and changes may be made by others, and equivalents employed, without departing from the sprit of the present invention. Accordingly, it is expressly intended that all such variations, changes and equivalents which fall within the spirit and scope of the present invention as defined in the claims, be embraced thereby.

The invention claimed is:

1. An antenna apparatus comprising:

a feed element;

a passive element provided so as to be distanced from the feed element;

a cable connected to the feed element;

a main circuit board to which the feed element and the passive element are mounted;

an antenna holder having a holder main surface on which the main circuit board with the feed element and the passive element is held;

a first feed element provided surface formed on the holder main surface of the antenna holder in order to hold the feed element; and a first passive element provided surface formed on the holder main surface of the antenna holder in order to hold the passive element, wherein the antenna holder includes a feed element holding portion protruding from the holder main surface so as to face the first feed element provided surface and the feed element is sandwiched between the first feed element provided surface and the feed element holding portion, and wherein the antenna holder includes a passive element holding portion protruding from the holder main surface so as to face the first passive element provided surface and the passive portion is held so as to be sandwiched between the passive element holding portion and the first passive element provided surface.

2. The antenna apparatus according to claim 1, wherein the first feed element provided surface and the first passive element provided surface are formed so as to be lower than the holder main surface.

3. The antenna apparatus according to claim 1, wherein the feed element includes a first feed portion, a second feed portion, a third feed portion, a fourth feed portion and a fifth feed portion, the second feed portion connected to one end of the first feed portion, the third feed portion connected to one end of the second feed portion, the fifth feed portion connected to one end of the third feed portion via the fourth feed portion, the first feed portion and the second feed portion are mounted on the first feed element provided surface.

4. The antenna apparatus according to claim 2, wherein the feed element includes a first feed portion, a second feed portion, a third feed portion, a fourth feed portion and a fifth feed portion, the second feed portion connected to one end of the first feed portion, the third feed portion connected to one end of the second feed portion, the fifth feed portion connected to one end of the third feed portion via the fourth feed portion, the first feed portion and the second feed portion are mounted on the first feed element provided surface.

5. The antenna apparatus according to claim 1, wherein: the antenna holder includes a first holder wall portion, a second holder wall portion, a third holder wall portion and a fourth holder wall portion, each holder wall portion extending from in the vicinity of a peripheral edge of the holder main surface, the first and the second holder wall portions facing each other, and the third and the fourth holder wall portions facing each other; the antenna holder includes plural feed element holding portions protruding from the holder main surface so as to face the first feed element provided surface and plural nail portions protruding from the first holder wall portion so as to be higher than the first feed element provided surface; and the first feed portion of the feed element is sandwiched between the first feed element provided surface and the feed element holding portions, and the first feed portion and the second feed portion of the feed element are positioned by means of the nail portions.

6. The antenna apparatus according to claim 2, wherein: the antenna holder includes a first holder wall portion, a second holder wall portion, a third holder wall portion and a fourth holder wall portion, each holder wall portion extending from in the vicinity of a peripheral edge of the holder main surface, the first and the second holder wall portions facing each other, and the third and the fourth holder wall portions facing each other; the antenna holder includes plural feed element holding portions protruding from the holder main surface so as to face the first feed element provided surface and plural nail portions protruding from the first holder wall portion so as to be higher than the first feed element provided surface; and the first feed portion of the feed element is sandwiched between the first feed element provided surface and the feed element holding portions, and the first feed portion and the second feed portion of the feed element are positioned by means of the nail portions.

7. The antenna apparatus according to claim 3, wherein: the antenna holder includes a first holder wall portion, a second holder wall portion, a third holder wall portion and a fourth holder wall portion, each holder wall portion extending from in the vicinity of a peripheral edge of the holder main surface, the first and the second holder wall portions facing each other, and the third and the fourth holder wall portions facing each other; the antenna holder includes plural feed element holding portions protruding from the holder main surface so as to face the first feed element provided surface and plural nail portions protruding from the first holder wall portion so as to be higher than the first feed element provided surface; and the first feed portion of the feed element is sandwiched between the first feed element provided surface and the feed element holding portions, and the first feed portion and the second feed portion of the feed element are positioned by means of the nail portions.

8. The antenna apparatus according to claim 4, wherein: the antenna holder includes a first holder wall portion, a second holder wall portion, a third holder wall portion and a fourth holder wall portion, each holder wall portion extending from in the vicinity of a peripheral edge of the holder main surface, the first and the second holder wall portions facing each other, and the third and the fourth holder wall portions facing each other; the antenna holder includes plural feed element holding portions protruding from the holder main surface so as to face the first feed element provided surface and plural nail portions protruding from the first holder wall portion so as to be higher than the first feed element provided surface; and the first feed portion of the feed element is sandwiched between the first feed element provided surface and the feed element holding portions, and the first feed portion and the second feed portion of the feed element are positioned by means of the nail portions.

9. The antenna apparatus according to claim 5, wherein: the antenna holder includes a feed element supporting portion formed at one end of the third holder wall portion, the feed element supporting portion facing an end surface of the first holder wall portion, the end surface being parallel to the third holder wall portion; and the third feed portion, the fourth feed portion and the fifth feed portion of the feed element are supported between the feed element supporting portion and the end surface of the first holder wall portion.

10. The antenna apparatus according to claim 6, wherein: the antenna holder includes a feed element supporting portion formed at one end of the third holder wall portion, the feed element supporting portion facing an end surface of the first holder wall portion, the end surface being parallel to the third holder wall portion; and the third feed portion, the fourth feed portion and the fifth feed portion of the feed element are supported between the feed element supporting portion and the end surface of the first holder wall portion.

11. The antenna apparatus according to claim 7, wherein: the antenna holder includes a feed element supporting portion formed at one end of the third holder wall portion, the feed element supporting portion facing an end surface of the first holder wall portion, the end surface being parallel to the third holder wall portion; and the third feed portion, the fourth feed portion and the fifth feed portion of the feed element are supported between the feed element supporting portion and the end surface of the first holder wall portion.

12. The antenna apparatus according to claim 8, wherein: the antenna holder includes a feed element supporting portion formed at one end of the third holder wall portion, the feed element supporting portion facing an end surface of the first holder wall portion, the end surface being parallel to the third holder wall portion; and the third feed portion, the fourth feed portion and the fifth feed portion of the feed element are supported between the feed element supporting portion and the end surface of the first holder wall portion.

13. The antenna apparatus according to claim 1, wherein: the passive element includes a first passive portion, a second passive portion and a third passive portion, the second passive portion connected to one end of the first passive portion, and the third passive portion connected to one end of the second passive portion;

the antenna holder includes plural passive element holding portions protruding from the holder main surface so as to face the first passive element provided surface; and the first passive portion and the second passive portion are held so as to be sandwiched between the passive element holding portions and the first passive element provided surface.

14. The antenna apparatus according to claim 2, wherein: the passive element includes a first passive portion, a second passive portion and a third passive portion, the second passive portion connected to one end of the first passive portion, and the third passive portion connected to one end of the second passive portion;

the antenna holder includes plural passive element holding portions protruding from the holder main surface so as to face the first passive element provided surface; and the first passive portion and the second passive portion are held so as to be sandwiched between the passive element holding portions and the first passive element provided surface.

15. The antenna apparatus according to claim 3, wherein: the passive element includes a first passive portion, a second passive portion and a third passive portion, the second passive portion connected to one end of the first passive portion, and the third passive portion connected to one end of the second passive portion;

the antenna holder includes plural passive element holding portions protruding from the holder main surface so as to face the first passive element provided surface; and the first passive portion and the second passive portion are held so as to be sandwiched between the passive element holding portions and the first passive element provided surface.

16. The antenna apparatus according to claim 5, wherein: the passive element includes a first passive portion, a second passive portion and a third passive portion, the second passive portion connected to one end of the first passive portion, and the third passive portion connected to one end of the second passive portion;

the antenna holder includes plural passive element holding portions protruding from the holder main surface so as to face the first passive element provided surface; and the first passive portion and the second passive portion are held so as to be sandwiched between the passive element holding portions and the first passive element provided surface.

17. The antenna apparatus according to claim 9, wherein: the passive element includes a first passive portion, a second passive portion and a third passive portion, the second passive portion connected to one end of the first passive portion, and the third passive portion connected to one end of the second passive portion;

the antenna holder includes plural passive element holding portions protruding from the holder main surface so as to face the first passive element provided surface; and the first passive portion and the second passive portion are held so as to be sandwiched between the passive element holding portions and the first passive element provided surface.

18. The antenna apparatus according to claim 13, wherein: the antenna holder includes a passive element supporting portion formed, at the side of one end of the second wall portion, and at an end of a protruding portion, the protruding portion extending from the fourth wall portion in a longitudinal direction of the first passive element provided surface so as to abut thereon, and the passive element supporting portion faces an end surface of the protruding portion, the end surface being parallel to the fourth wall portion; and the third passive portion of the passive element is supported between the protruding portion and the passive element supporting portion.

19. The antenna apparatus according to claim 14, wherein: the antenna holder includes a passive element supporting portion formed, at the side of one end of the second wall portion, and at an end of a protruding portion, the protruding portion extending from the fourth wall portion in a longitudinal direction of the first passive element provided surface so as to abut thereon, and the passive element supporting portion faces an end surface of the protruding portion, the end surface being parallel to the fourth wall portion; and the third passive portion of the passive element is supported between the protruding portion and the passive element supporting portion.

20. The antenna apparatus according to claim 15, wherein: the antenna holder includes a passive element supporting portion formed, at the side of one end of the second wall portion, and at an end of a protruding portion, the protruding portion extending from the fourth wall portion in a longitudinal direction of the first passive element provided surface so as to abut thereon, and the passive element supporting portion faces an end surface of the protruding portion, the end surface being parallel to the fourth wall portion; and the third passive portion of the passive element is supported between the protruding portion and the passive element supporting portion.

* * * * *